US007182428B2

(12) United States Patent
Le Gallo

(10) Patent No.: US 7,182,428 B2
(45) Date of Patent: Feb. 27, 2007

(54) DEVICE FOR CLEANING INK INJECTION NOZZLES

(75) Inventor: Stéphane Le Gallo, Savigny-sur-Orge (FR)

(73) Assignee: Neopost Industrie, Bagneux (FR)

( * ) Notice: Subject to any disclaimer, the term of this patent is extended or adjusted under 35 U.S.C. 154(b) by 304 days.

(21) Appl. No.: 10/898,500

(22) Filed: Jul. 23, 2004

(65) Prior Publication Data

US 2006/0017768 A1 Jan. 26, 2006

(30) Foreign Application Priority Data

Aug. 6, 2003 (FR) ..... 03 09687

(51) Int. Cl.
*B41J 2/165* (2006.01)

(52) U.S. Cl. ..... 347/33

(58) Field of Classification Search ..... 347/22–24, 347/28–30, 32, 33
See application file for complete search history.

(56) References Cited

U.S. PATENT DOCUMENTS 5,189,442 A * 2/1993 Herbert ..... 347/2
5,757,387 A * 5/1998 Manduley ..... 347/2
5,806,994 A * 9/1998 Coffy et al. ..... 400/120.01
5,813,326 A 9/1998 Salomon ..... 101/93
5,880,755 A * 3/1999 Fajour et al. ..... 347/33
5,883,648 A 3/1999 Hetzer ..... 347/33
6,183,059 B1 * 2/2001 Muhl et al. ..... 347/33
6,585,347 B1 7/2003 Johnson et al. ..... 347/22
6,851,787 B2 * 2/2005 Johnson ..... 347/22
2002/0040354 A1 4/2002 Deshayes et al. ..... 705/401
2002/0044168 A1 4/2002 Hashi et al. ..... 347/32

* cited by examiner

*Primary Examiner*—Shih-Wen Hsieh
(74) *Attorney, Agent, or Firm*—Perman & Green, LLP

(57) ABSTRACT

This invention relates to a device for cleaning the ink ejection nozzles of an inkjet printer head of a mail handling machine, comprising, on the one hand, a scraping means arranged in a path of travel of the mail items opposite the ink ejection nozzles and actuated by a mail item as it advances beneath the printer head, and, on the other hand, a means for cleaning this scraping means. Advantageously, the scraping means is articulated between a position of scraping in which the scraping means is arranged in the path of travel of the mail items, and a position of rest in which the scraping means is withdrawn from this path of travel.

13 Claims, 6 Drawing Sheets

FIG.8
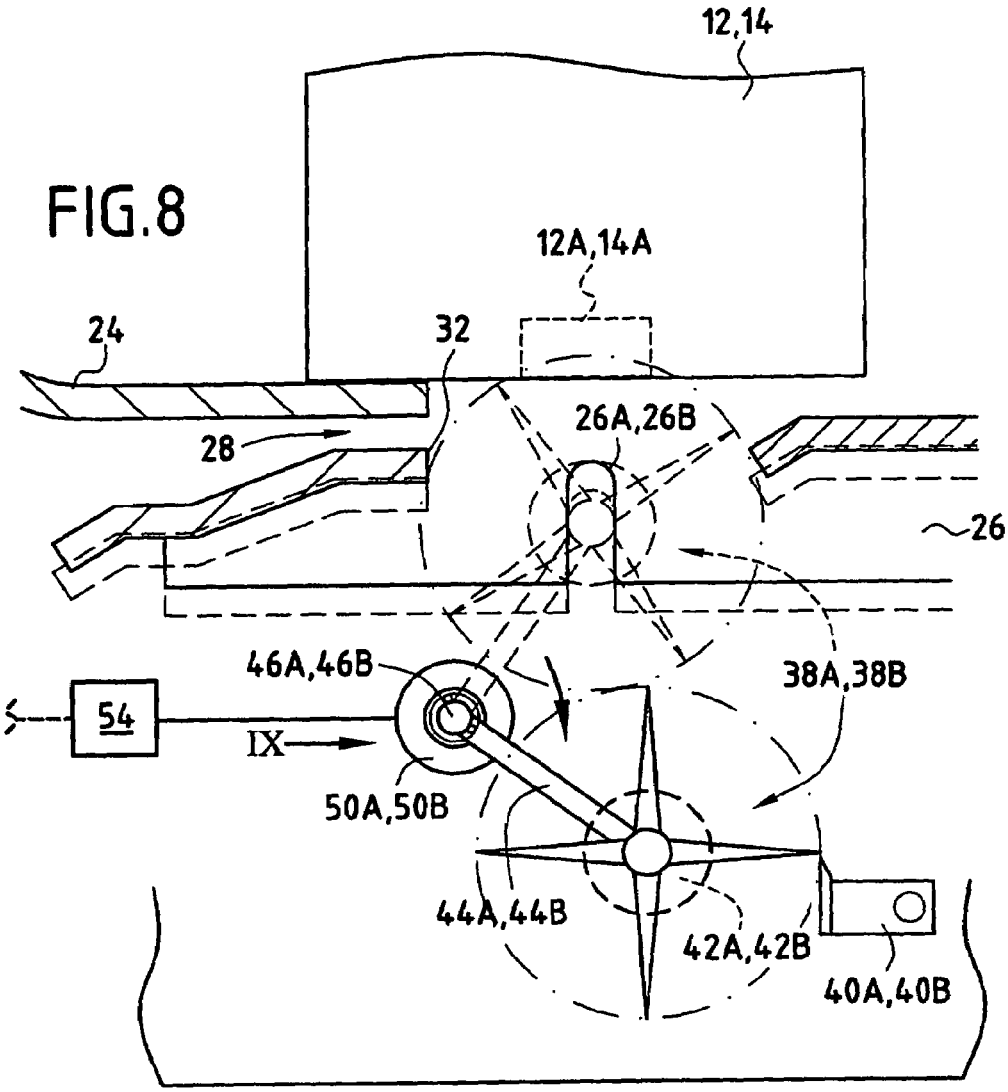
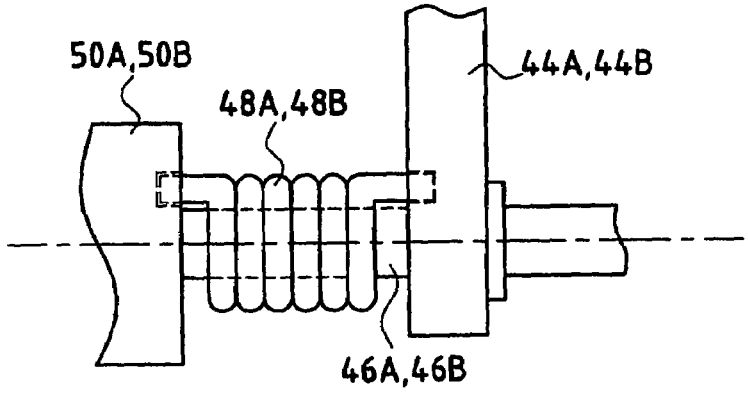
FIG.9

DEVICE FOR CLEANING INK INJECTION NOZZLES

FIELD OF THE INVENTION

The present invention relates to the domain of mail handling and more particularly to a device for cleaning the ink ejection nozzles of an ink jet printer head of a machine for franking the mail items.

BACKGROUND OF THE INVENTION

Traditionally, the ink ejection nozzles of a franking machine are cleaned periodically when the printer head is moved away from the path of travel of the mail items and arranged in a so-called maintenance position in which the ink ejection nozzles are subjected to scraper means which remove therefrom any pollutants (dried ink particles, paper waste, for example) which they may have accumulated during the preceding printings. U.S. Pat. No. 5,813,326 illustrates such a device perfectly.

This solution, generally applicable to numerous models of mail handling machines, is globally satisfactory. However, it presents certain drawbacks. Firstly, it necessitates periodically stopping the printing process unless two printer heads, functioning alternately, are provided, as proposed by Applicants in their Patent Application U.S. 2002/0040354A1, a solution which is expensive and therefore difficult to envisage on a low-market franking machine. Secondly, the moment when the ink ejection nozzles begin to get clogged varies considerably, depending on the quality of paper used for printing. In particular, when this paper is of very low quality, the ejection nozzles may begin to clog up very rapidly, for example after 10 printings already, which in practice prohibits any recourse to a maintenance station even with low handling rates.

It is an object of the present invention to propose a device for cleaning the ink ejection nozzles, which does not necessitate passage of these nozzles to a maintenance station and which may therefore be employed during their functioning. Another object of the present invention is to propose a simple, inexpensive device which may be installed on low-market franking machines.

SUMMARY OF THE INVENTION

These objects are attained by a device for cleaning the ink ejection nozzles of an inkjet printer head of a mail handling machine, characterized in that it comprises a scraping means arranged in a path of travel of the mail items opposite the ejection nozzles and actuated by a mail item as it advances beneath the printer head.

With this configuration, the polluted nozzles are cleaned directly during printing of the mail items. It is therefore no longer necessary to stop the machine for the traditional scraping of these nozzles at a maintenance station.

The scraping means, which preferably comprises a possibly motorized vaned wheel, is articulated between a position of scraping in which the scraping means is arranged in the path of travel of the mail items, and a position of rest in which the scraping means is withdrawn from this path of travel.

A means is advantageously provided for cleaning said scraping means, which comprises a scraper that rubs each vane of the vaned wheel.

When said wheel is mounted on a pivoting support arm which may move between the position of scraping and the position of rest, the displacement of said support arm may be controlled as a function of the number of mail items counted by a position sensor disposed on the path of travel of the mail items. This position sensor is advantageously disposed upstream of said scraping means.

BRIEF DESCRIPTION OF THE DRAWINGS

The invention will be more readily understood on reading the following description given by way of non-limiting example, with reference to the accompanying drawings, in which:

FIGS. 8 and 9 illustrate details on a larger scale of a variant of the embodiment of FIG. 7.

DESCRIPTION OF PREFERRED EMBODIMENTS

Figure 10:
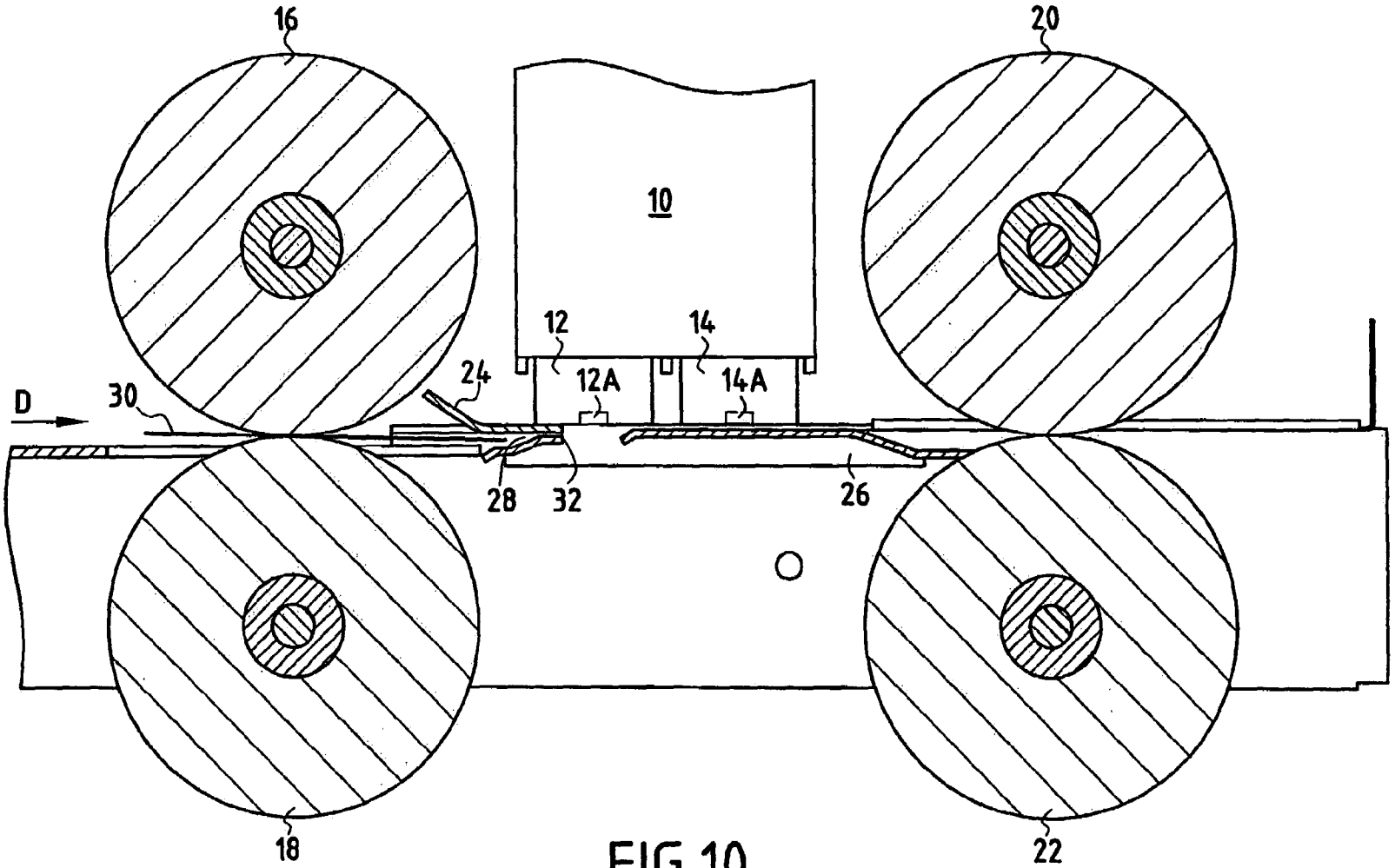
FIG.10 PRIOR ART
FIG. 10 is a partial view of a franking machine of the prior art at the level of the printing means.

Referring now to the drawings, FIG. 10 is a partial view of a mail handling machine at the level of the printing means. The printer head 10 which conventionally comprises two printing modules 12, 14 offset in a direction perpendicular to direction D of advance of the mail items, is mounted between two series of drive rollers, a first series of two upstream rollers 16, 18 which are superposed and of which one, preferably the upper roller 16, is motorized, and a second series of two downstream rollers 20, 22, likewise superposed, of which one, preferably the upper roller 20, is motorized. At the level of the printing means, an upper fixed plate 24 and a lower mobile plate 26 (also called mobile ski) define a path 28 for conveying the mail items 30. These plates are of course perforated opposite the ink ejection nozzles 12A, 14A of each printing module. Reference 32 illustrates one of the corresponding openings (the second 34 is to the rear of the plane of section due to the offset of the two modules).

In the mail handling machines of the prior art, the printer head 10 is mobile and may take two positions: a position of printing in which the printing of postal indicia is possible and a position of rest or of maintenance in which this printer head is withdrawn from the path of travel 28 at the level of a maintenance station in order to allow the ink ejection nozzles to be cleaned, therefore prohibiting any printing of postal indicia.

Figure 1:
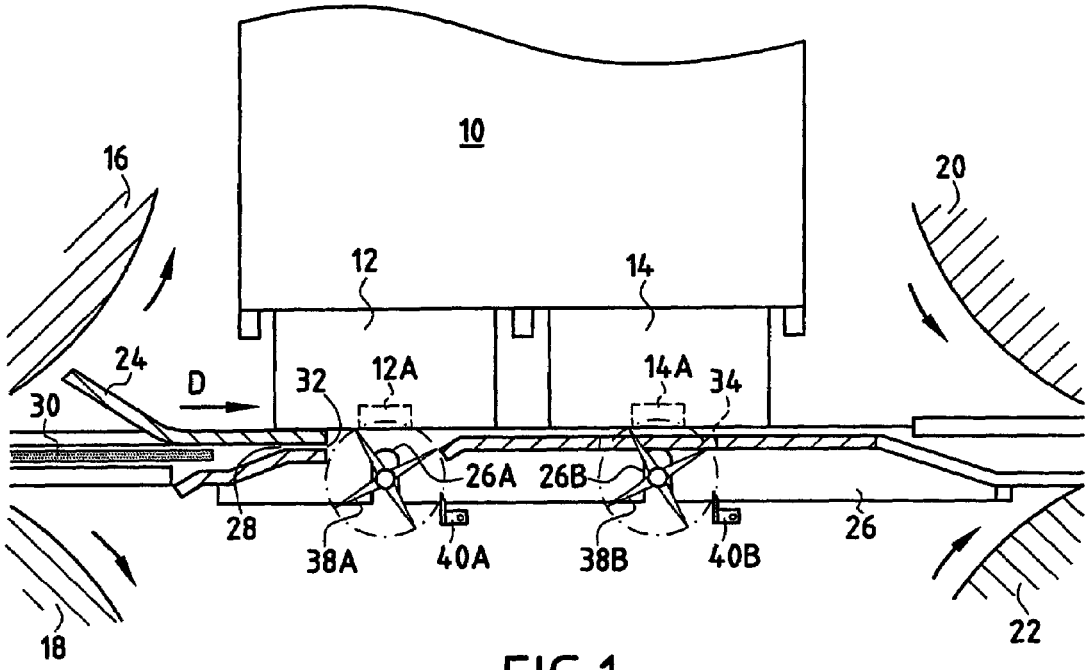
FIG. 1 is a schematic view of a first form of embodiment of the invention.

According to the invention, and as illustrated by the first form of embodiment of FIG. 1, the printer head 10 is now fixed in the printing position and the cleaning of the ink ejection nozzles is effected directly in this position, i.e. in the very course of the printing process.

To that end, a scraping means is provided, arranged in the path 28 of travel of the mail items opposite the ink ejection nozzles 12A, 14A and actuated by a mail item 30 as it advances beneath these nozzles. More precisely, this scraping means comprises two vaned wheels 38A, 38B each provided with at least one vane or blade and disposed opposite a row of nozzles 12A, 12B of a given printing module, in the opening made in the fixed (24) and mobile (26) plates, and whose rotation is controlled by the advance of a mail item. The vaned wheel 38A, 28B being fixed, i.e. fast with the body of the mail handling machine, a slot 26A, 26B is provided in the mobile plate 26 so as to allow the displacement of this plate as a function of the thickness of the mail item. Of course, each vane combines an elasticity and rigidity conductive to an efficient cleaning without alteration of the nozzles.

Figure 2:
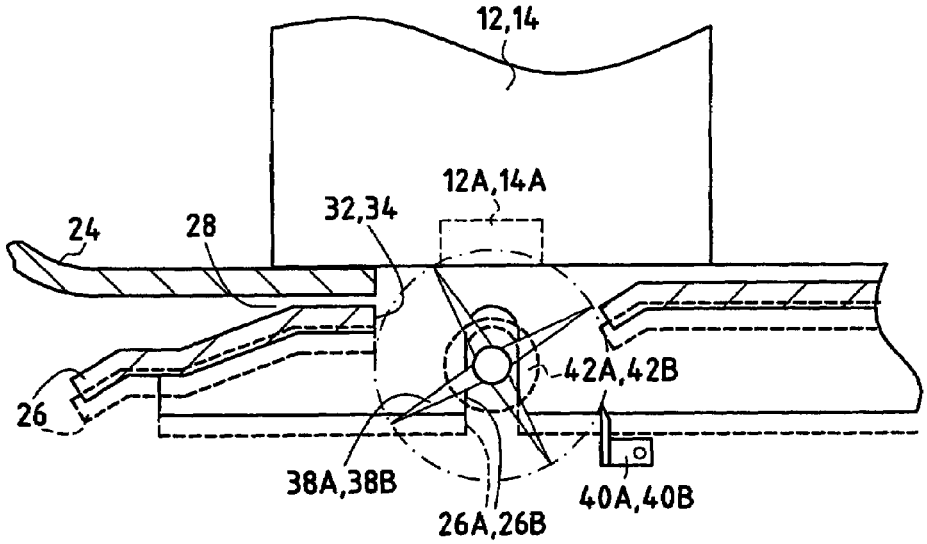
FIG. 2 is a detail of FIG. 1, on a larger scale, in a variant embodiment.
Figure 3:
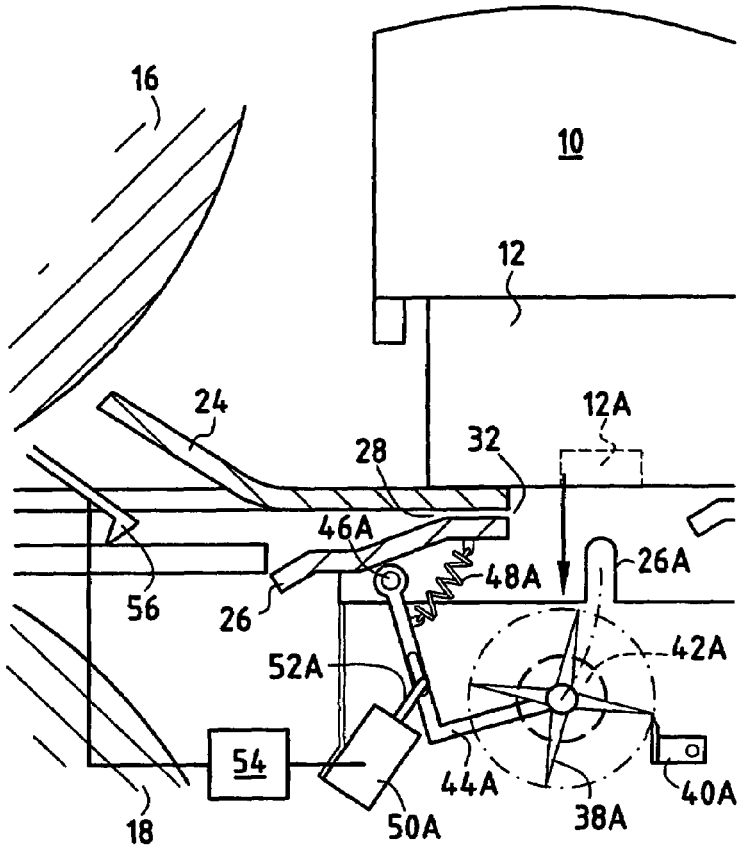
FIG. 3 is a detail on a larger scale of a second form of embodiment of the invention.
Figure 4:
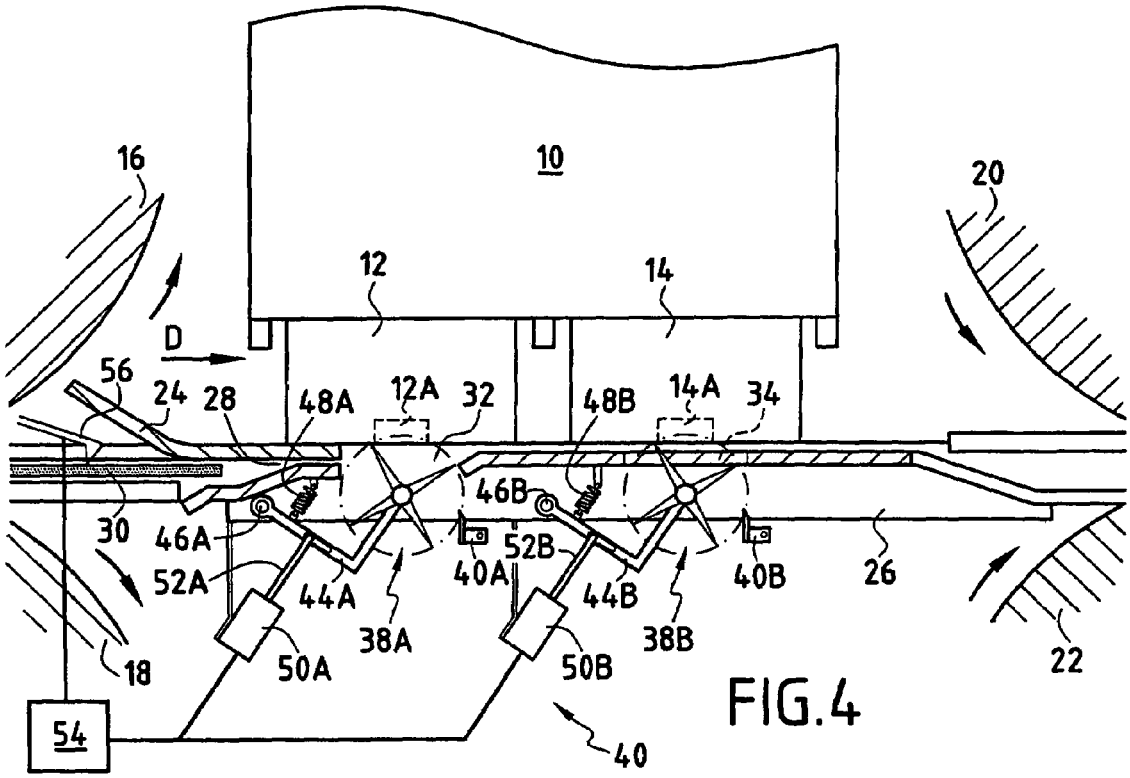
FIGS. 4, 5 and 6 are schematic views of the second embodiment.
Figure 5:
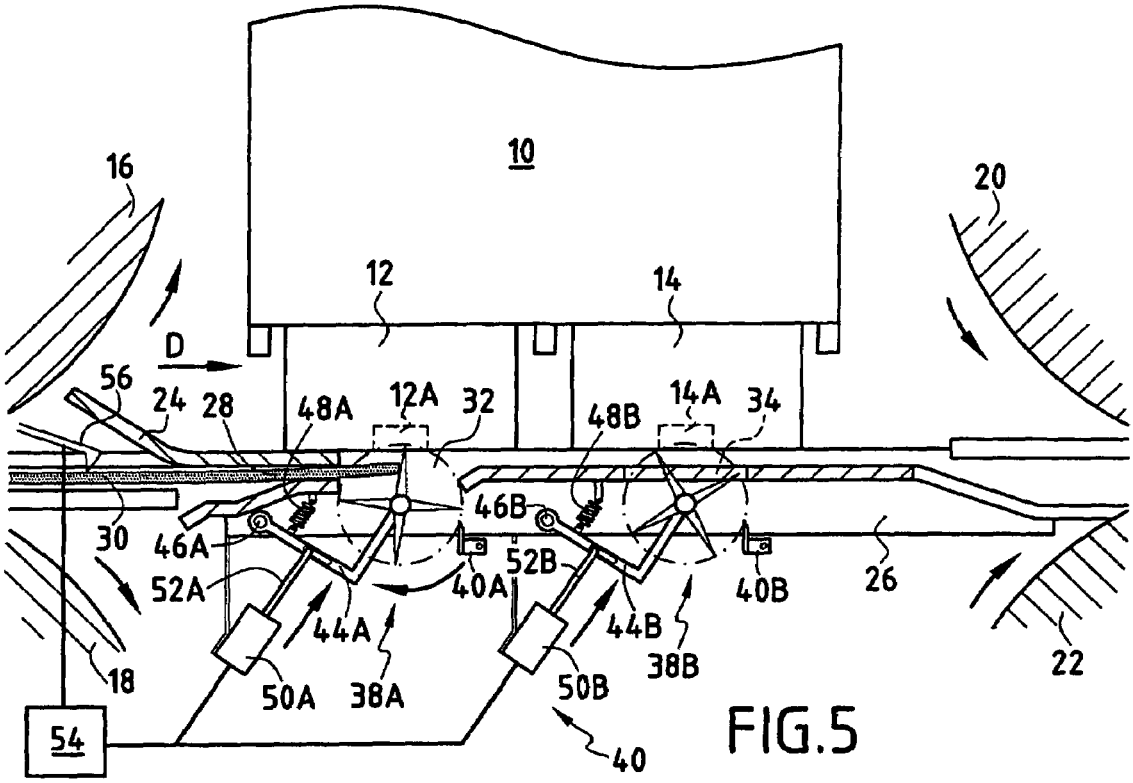
Figure 6:
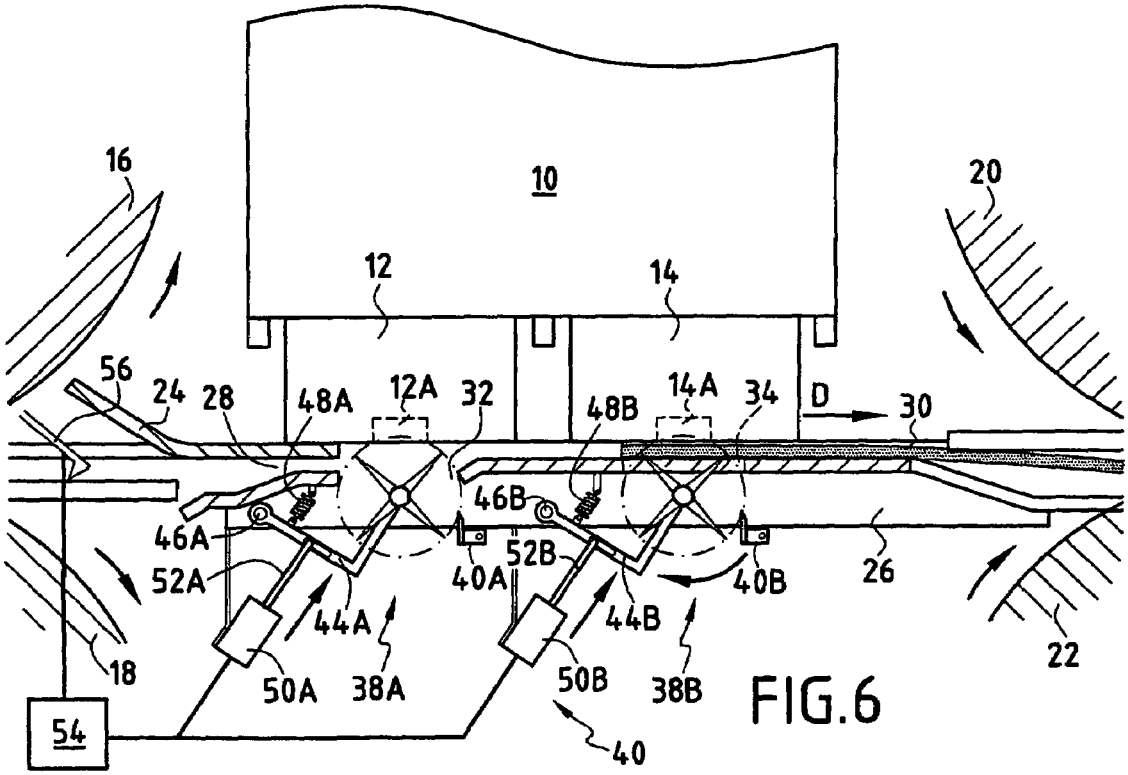

In order to guarantee that the efficiency of the scraping means is maintained, the latter cooperates with a means for automatically cleaning the vanes polluted by the debris issuing from the ink ejection nozzles, formed by a scraper 40A, 40B which is fixed, i.e. fast with the body of the mail handling machine, and on which the vanes of the vaned wheels 38A, 38B will rub one after the other. FIG. 2 illustrates a variant embodiment of FIG. 1 in which the vaned wheel 38A, 38B is motorized by a motor 42A, 42B so that the ejection nozzles may also be scraped between mail items, and even in the absence of mail items.

A second form of embodiment of the invention is illustrated in FIGS. 3 to 6. In this embodiment, each wheel provided with at least one vane or blade is mounted on a support arm 44A, 44B pivoting about a pivot pin 46A, 46B fast with the mobile plate 26, against an elastic means, for example a spring 48A, 48B fast with this support arm at one end and with the mobile plate at its other end. This spring assembly makes it possible to clean the nozzles with an optimal effort of application.

The support arm may move between a position of scraping (corresponding to the position of the first embodiment) and a position of rest withdrawn from the path of travel (preferably retracted beneath this path and in that case also being cleared from the zone of ejection of the nozzles, if necessary) under the action of a control means, for example a motor or an electromagnet 50A, 50B of which the drive shaft or the corresponding control rod 52A, 52B is connected to the associated support arm. If necessary, and depending on the configuration of the mail handling machine, kinematics incorporating levers and pulleys (not shown) may be provided between this control means and the vaned wheels. The control means is actuated from a processing means 54 as a function of different parameters including the number of mail items counted by a position sensor, of the rocking lever type 56, disposed on the path of travel of the mail items upstream of the scraping means and actuated by the leading edge of each mail item. This number of mail items may be set as a function of the type of paper used or of any other consideration, for example the country in which the machine is installed. In this way, in this embodiment, the scraping of the nozzles is not effected during the printing of each mail item but after passage of a determined number of these items.

In order to guarantee an optimal efficiency for the scraping means, and as previously, the latter cooperates in its position of rest with a means for automatically cleaning the polluted vanes, formed by the fixed scraper 40A, 40B fast with the body of the machine and on which the blades of the vaned wheels 38A, 33B will rub one after the other under the effect of the motorization of the wheel 38A, 38B. Cleaning may or may not be synchronized with the return of the support arm in its position of rest. In this way, for example, scraping of the nozzles may be effected every 10 printing but the cleaning vanes (therefore the launching of the motorization 42A, 42B) only every 100 printings.

Figure 7:
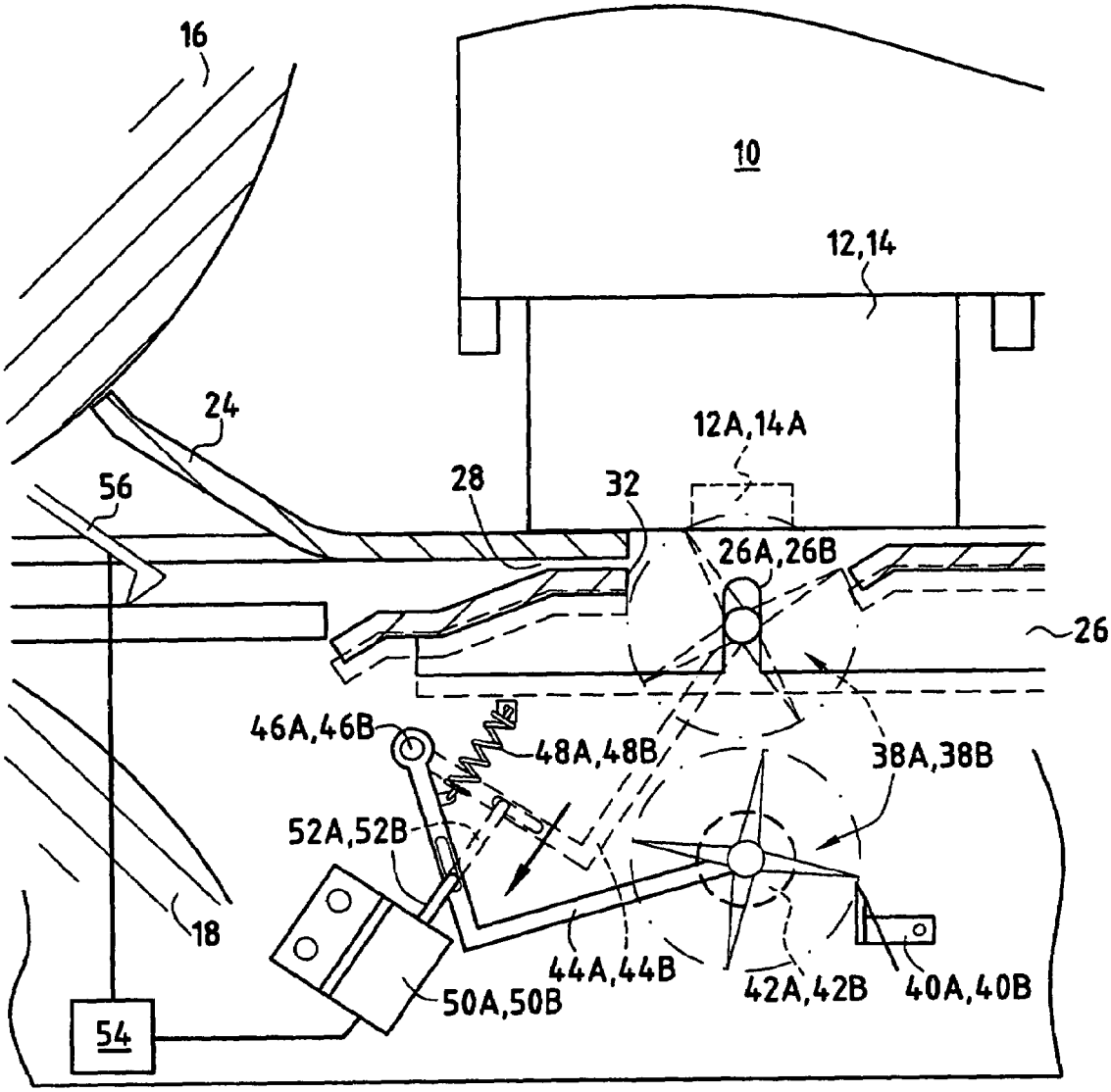
FIG. 7 is a detail on a larger scale of a third form of embodiment of the invention.

FIG. 7 illustrates a third form of embodiment of the invention in which the pivot pin 46A, 46B of the support arm 44A, 44B and the control means 50A, 50B are no longer fixed on the mobile plate but fixed directly on the body of the mail handling machine. With this advantageous embodiment, the control of the motor is simplified, as it is no longer necessary to compensate the displacement of the mobile plate 26, the distance between vaned wheel and nozzles now being fixed.

A variant embodiment of FIG. 7 is illustrated in FIG. 8. In this variant, the control means 50A, 50B is disposed directly on the pivot pin 46A, 46B which, in addition, supports the elastic means 48A, 48B. In this way, a more compact embodiment is obtained, which may then be easily integrated in existing machines without noteworthy structural modification.

The present invention is, of course, not limited solely to the Figures illustrated, and the person skilled in the art will be able to complete them without showing proof of inventive activity. For example, in order to promote the progressive evacuation of the dried ink particles and of paper while significantly reducing the scraping efforts exerted on the nozzles, the vaned wheel may present the form of a drill (or endless screw), each helicoidal cutting edge corresponding to a scraping edge of a blade. Similarly, although the invention has been illustrated with a printer head with two modules, it can equally well be envisaged to resort to one sole module.

What is claimed is:

1. Device for cleaning ink ejection nozzles of an inkjet printer head of a mail handling machine, wherein it comprises a scraping means arranged in a path of travel of mail items opposite the ink ejection nozzles and actuated by a mail item as it advances beneath the printer head.

2. The cleaning device of claim 1, wherein the device further comprises a means for cleaning said scraping means.

3. The cleaning device of claim 1, wherein said scrapping means comprises a vaned wheel.

4. The cleaning device of claim 3, wherein a cleaning means for cleaning said vaned wheel comprises a scraper which rubs each vane of the vaned wheel.

5. The cleaning device of claim 3, wherein said vaned wheel is motorized.

6. Device for cleaning ink ejection nozzles of an inkjet printer head of a mail handling machine, comprising:

a scraping means that is articulated between a position of scraping in which the scraping means is arranged in a path of travel of mail items, and a position of rest in which the scraping means is withdrawn from this path of travel, wherein the scraping means is opposite the ink ejection nozzles and actuated by a mail item as it advances beneath the printer head.

7. The cleaning device of claim 6, wherein it further comprises a means for cleaning said scraping means.

8. The cleaning device of claim 7, wherein said scraping means comprises a vaned wheel and said cleaning means comprises a scraper which rubs each vane of the vaned wheel.

9. The cleaning device of claim 6, wherein said scrapping means comprises a vaned wheel.

10. The cleaning device of claim 9, wherein said vaned wheel is mounted on a pivoting support arm that may move between the position of scraping and the position of rest.

11. The cleaning device of claim 10, wherein the displacement of said support arm is controlled as a function of the number of mail items counted by a position sensor arranged on the path of travel of the mail items.

12. The cleaning device of claim 11, wherein said position sensor is arranged upstream of said scraping means.

13. The cleaning device of claim 9, wherein said vaned wheel is motorized.

* * * * *